US005501055A

United States Patent [19]

Storch et al.

[11] Patent Number: 5,501,055

[45] Date of Patent: Mar. 26, 1996

[54] METHOD FOR REINFORCED CONCRETE CONSTRUCTION

[76] Inventors: Herman Storch, Paraguay 2957-9E, 1425 Buenos Aires, Argentina; Ernesto E. Storch, Granadilla 28-2C, 28220 Majahahonda, Madrid, Spain

[21] Appl. No.: 163,046

[22] Filed: Dec. 6, 1993

[30] Foreign Application Priority Data

Dec. 18, 1992 [ES] Spain ..... 9202572

[51] Int. Cl.[6] ..... E04C 1/00; B32B 5/18

[52] U.S. Cl. ..... 52/741.1; 52/600; 52/309.12; 52/383; 52/745.19; 264/35; 264/333

[58] Field of Search ..... 52/600, 650.2, 52/650.1, 651.09, 309.7, 309.11, 309.12, 309.17, 383, 428, 694, 741.1 OR, 337, 454, 745.19; 264/35, 275, 333

[56] References Cited

U.S. PATENT DOCUMENTS

| | | | |
|---|---|---|---|
| 2,140,283 | 12/1938 | Faber . | |
| 3,347,007 | 10/1967 | Hale | 52/600 |
| 3,879,908 | 4/1975 | Weismann | 52/600 X |
| 3,930,348 | 1/1976 | Wise | 52/600 |
| 4,056,908 | 11/1977 | McManus . | |
| 4,104,842 | 8/1978 | Rockstead et al. . | |
| 4,336,676 | 6/1982 | Artzer . | |
| 4,386,489 | 6/1983 | Sheahan | 52/694 |
| 4,454,695 | 6/1984 | Person . | |
| 4,494,349 | 1/1985 | Clements | 52/309.12 X |
| 4,505,019 | 3/1985 | Deinzer | 52/309.12 X |
| 4,611,450 | 9/1986 | Chen | 52/309.12 X |
| 4,864,792 | 9/1989 | André et al. | 52/454 X |
| 4,943,336 | 7/1990 | Csont | 52/309.17 X |
| 5,140,794 | 8/1992 | Miller | 52/309.12 |

*Primary Examiner*—Wynn E. Wood
*Attorney, Agent, or Firm*—Jerry T. Kearns

[57] ABSTRACT

A reticulated net for use in reinforced concrete construction includes a first plurality of evenly spaced coplanar rods forming an upper rim and a second plurality of evenly spaced coplanar rods forming a lower rim. The rods of the upper and lower rims are laterally offset and connected by triangular waveform connecting rods. Each connected adjacent pair of upper and lower rods, in conjunction with the associated connecting rod, forms an individual truss member. Pursuant to the disclosed method for reinforced concrete construction, to pour a concrete slab, inexpensive permanent concrete forms are disposed within the upper and lower rims of the net. After completion, lower portions of the net remain exposed to facilitate securement of conventional construction elements such as electrical boxes, suspending ceilings, insulation, lighting fixtures, sprinkling systems, partition wall systems, etc. Important advantages include the stacking of net sections in nested relation for transportation and storage, the obviation of the need for conventional temporary scaffolding and concrete forms in high rise construction, and the ability to modify the net or net portions to accommodate a variety of design requirements.

11 Claims, 4 Drawing Sheets

METHOD FOR REINFORCED CONCRETE CONSTRUCTION

BACKGROUND OF THE INVENTION

1. Field of the Invention

The present invention relates to reinforced concrete construction, and more particularly pertains to a method and apparatus for reinforced concrete construction for use in the construction of buildings, bridges, aqueducts, and other structures.

2. Description of the Prior Art

Concrete and other cementitious materials typically exhibit high compressive strength characteristics, but rather low tensile strength characteristics. In order to increase the tensile strength of concrete sufficiently to enable its use in various structures, it has been known for many years to provide imbedded reinforcement members in the concrete. Such reinforcing members typically take the form of steel rods, mesh, cables, and the like which are put into position in molds or forms prior to pouring the concrete. A variety of patents disclose various methods and apparatus related to reinforced concrete construction.

For example, U.S. Pat. No. 2,140,283 which issued to H. Faber on Nov. 21, 1936 discloses a monolithic slab floor construction including a plurality of imbedded sheet metal truss members within a gypsum and sawdust matrix. U.S. Pat. No. 4,056,908 which issued to I. McManus on Nov. 8, 1977 discloses a reinforced concrete slab construction in which apex portions of steel joist webbing members are anchored within the concrete slab. U.S. Pat. No. 4,104,842 which issued to R. Rockstead et al. on Aug. 8, 1978 discloses a skeleton wall structure including an imbedded reinforcement structure including mesh and generally sinusoidal truss members. U.S. Pat. No. 4,336,676 which issued to R. Artzer on Jun. 29, 1982 discloses a hollow core expanded foam panel construction including an imbedded wire reinforcement matrix having a plurality of generally sinusoidal trusses. U.S. Pat. No. 4,454,695 which issued to J. Person on Jun. 19, 1984 discloses a reinforced concrete floor construction system in which upper apex portions of steel joist trusses protrude through corrugated steel decking panels and into a poured concrete slab.

The above-described prior art construction methods suffer from one or more of the following drawbacks: (1) erection of the reinforcement members requires a great deal of labor; (2) the reinforcing members are not readily adaptable for the custom construction of various different architectural features depending on the individualized requirements of each particular project; (3) the reinforcing members do not collapse to a minimum volume configuration to reduce transportation and storage costs; and (4) the reinforcing members do not provide sufficient structural integrity to support concrete molds or forms in the absence of the provision of additional temporary supports or scaffolds.

SUMMARY OF THE INVENTION

Accordingly, it is an object of the present invention to provide a metallic net reinforcement structure, built by profiles, mainly iron rods, for the construction of structural floors, walls, roofs, columns, bridges, with sections varying according to static calculations.

It is a further object of the present invention to provide a new and improved network of metallic truss members readily adaptable for the custom construction of various different architectural features depending on the individualized requirements of each particular project.

An even further object of the present invention is to provide a new and improved network of metallic truss members which stack in a minimum volume configuration to reduce transportation and storage costs.

Still another object of the present invention is the provision of a reinforcing truss system for use in reinforced concrete construction which includes a particular formation of consecutive series of equal pyramids, allowing and easing the loading and transportation in a limited volume (i.e., a truck bed) of a large quantity of prefabricated truss members already cut to required dimensions for a particular project.

Yet another object of the present invention is the creation of beams, trusses, columns, and special structures, employing a new and improved reinforcing truss system.

Even still another object of the present invention is the provision of a concrete reinforcing truss system providing sufficient structural integrity to support permanent concrete molds or forms in the absence of the provision of additional temporary supports or scaffolds.

An even further object of the present invention is the provision of a concrete reinforcing truss system which allows the use of inexpensive non-reusable concrete molds and forms.

Yet another object of the present invention is the provision of a concrete reinforcing truss system which may be completely erected to form an initial structural skeleton for a particular project prior to the pouring of concrete.

DETAILED DESCRIPTION OF THE PREFERRED EMBODIMENT(S)

Figure 1:
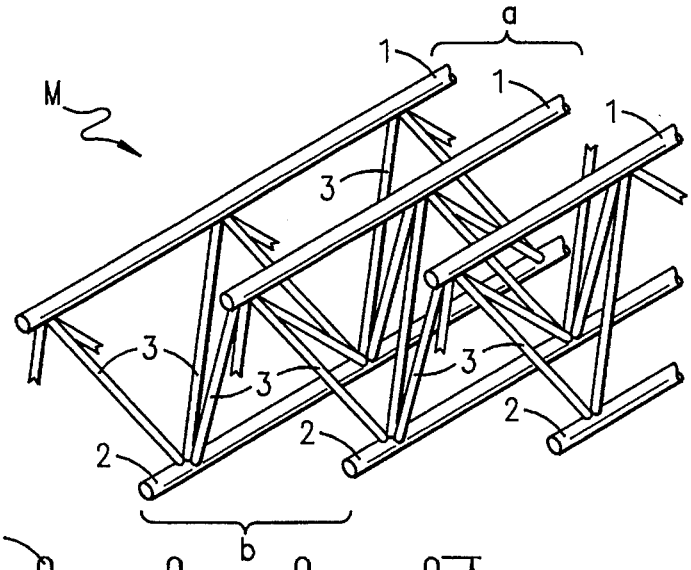
FIG. 1 is a perspective view of a portion of a structural net embodying the principles of the present invention.
Figure 2:
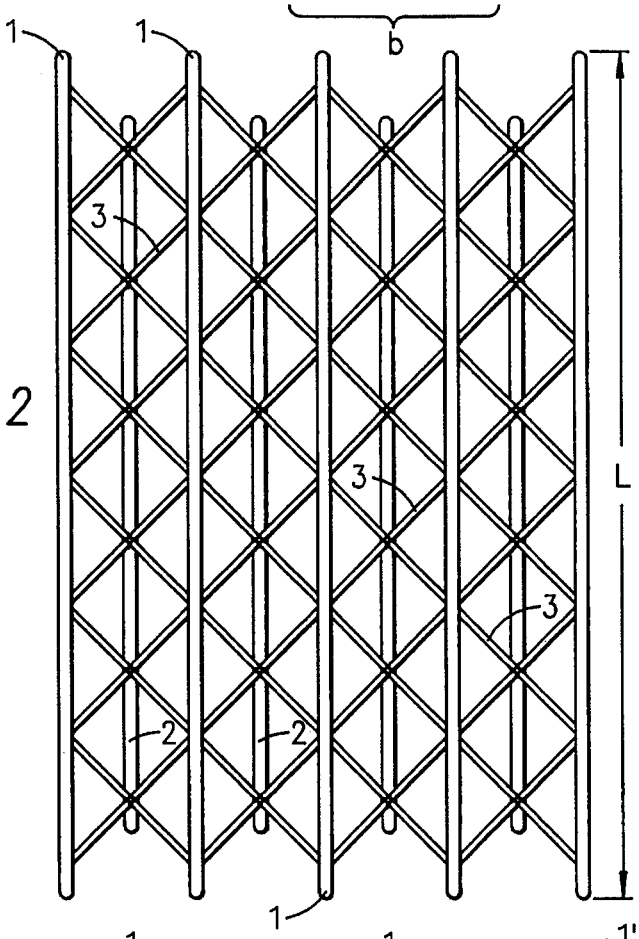
FIG. 2 is a top plan view of the net of FIG. 1.
Figure 4:
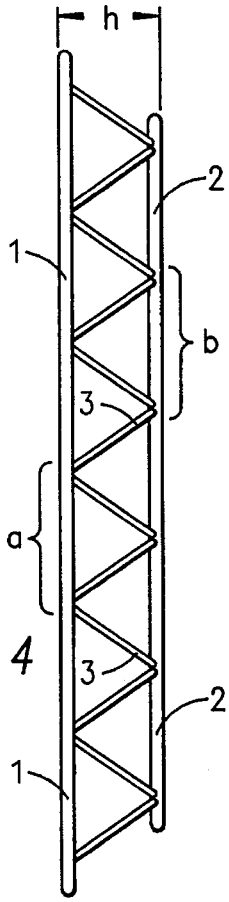
FIG. 4 is a side elevational view of the net of FIG. 2.

With reference to the drawings, wherein like reference characters designate corresponding structure throughout the views, the novel and improved method and apparatus for reinforced concrete construction according to several preferred embodiments of the present invention will be described hereafter.

A reinforcement net M according to a first preferred embodiment of the invention, illustrated in FIGS. 1 through 4, includes plurality of straight rods 1 and 2 rigidly connected by a plurality of rods 3 each deformed to a sawtooth or triangular wave configuration. A variety of conventional connecting means may be employed, including welding, wire ties, etc. Upper rods 1 extend in equally spaced parallel relation and lie in a common plane, forming an upper rim a. In a similar manner, lower rods 2 also extend in equally spaced parallel relation and lie in a common plane, forming a lower rim b. Vertical separation of the rims a and b defines the overall height h of the net M, which may have a predetermined length L and width W determined upon the particular intended application and/or available modes of transportation.

Inclination of the connecting rods 3 which connect rods 1 and 2 results in a uniform transverse offset between rods 1 and 2, such that the rods 2 do not directly underlie the rods 1. The waveform connecting rods 3 form inclined reticulated frames alternately connecting the series of upper rods 1 and lower rods 2, forming an integrated rigid corrugated or triangular waveform reticulated net configuration. The continuous linking rods 3 and each connected pair of rods 1 and 2 form individual trusses which may be separated from the net M as required by particular construction requirements in order to form predetermined size slabs, beams, or columns.

The rods 1, 2, and 3 forming the net M may be formed from a variety of different materials without departing from the scope of the present invention, including galvanized iron, stainless steel, aluminum, or plastic. While the net M has been illustrated in connection with the use of rods having a circular transverse cross-sectional shape, it should be noted that rods employing other transverse cross-sectional shapes might also be employed in the practice of the invention. Additionally, the gage or diameter of rods 1, 2, and 3 may be varied in different locations in the net M for accommodating different design loads for diverse locations within the same net.

Figure 13A:
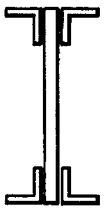
FIG. 13*a* is a diagrammatic transverse cross-sectional view illustrating a first conventional type of reticulated beam employed in reinforced concrete construction.
Figure 13B:
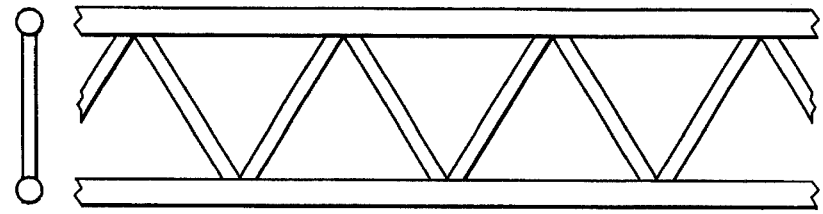
FIG. 13*b* is a diagrammatic longitudinal cross-sectional view illustrating a second conventional type of reticulated beam employed in reinforced concrete construction.
Figure 14:
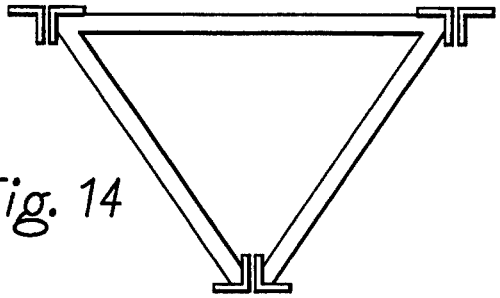
FIG. 14 is a diagrammatic transverse cross-sectional view of a third conventional type of reticulated beam employed in reinforced concrete construction.
Figure 15A:
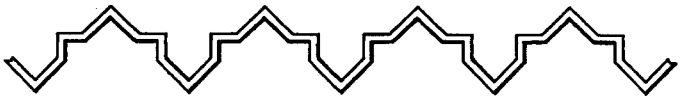
FIG. 15*a* is a diagrammatic transverse cross-sectional view of a first conventional type of metallic deck used in reinforced concrete construction.
Figure 15B:
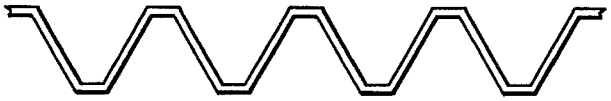
FIG. 15*b* is a diagrammatic transverse cross-sectional view of a second conventional type of metallic deck used in reinforced concrete construction.
Figure 16:
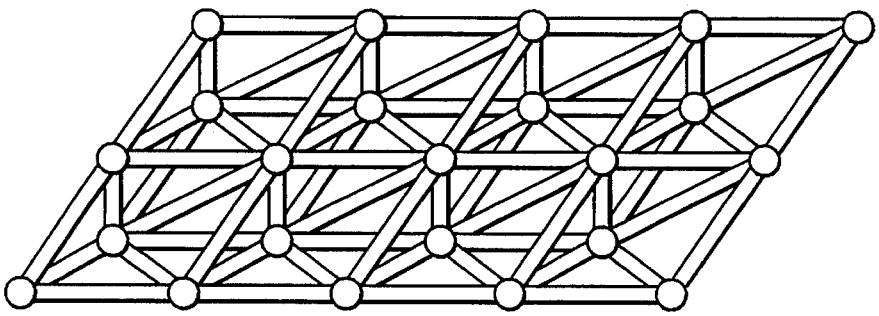
FIG. 16 is a diagrammatic perspective view illustrating a conventional reinforcing structure for use in reinforced concrete construction, formed by the on-site connection of individual preformed truss members by transverse rods.
Figure 17:
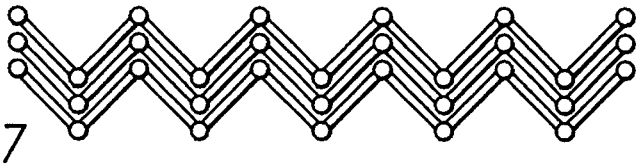
FIG. 17 is a diagrammatic perspective view illustrating the manner of stacking reinforcing nets according to the present invention for transportation and storage.

The net M is thus constituted by a series of connected reticulated inclined beams or trusses, whose individual function is similar to the widely used conventional vertical and inclined beams represented in FIGS. 13a and 13b, and in FIG. 14. By preforming the beams in an integrated net the present invention provides for simpler on-site assembly than the traditional individual beams arrangement, thus saving time and substantially reducing labor costs.

Figure 5:
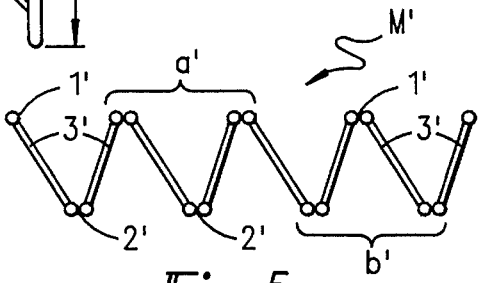
FIG. 5 is a transverse cross-sectional view of a modified form of the net of FIG. 2, provided with additional rods responding to particular structural requirements.

A second somewhat modified preferred embodiment M' of the invention, illustrated in FIG. 5, is also constituted by a plurality of spaced rods 1' and 2' connected by waveform rods 3' to form upper rim a' and lower rim b'. However, instead of a continuous integrated rigid net, the net M' includes a plurality of pairs of rods 1' and 2' connected by rods 3' placed to form the upper and lower rims of the net M'. The rod pairs 1' and 2' are welded or tied together with wire, resulting in an assembly of consecutive inclined beams or armours of columns and beams which may be separated depending upon particular construction requirements.

Figure 3:
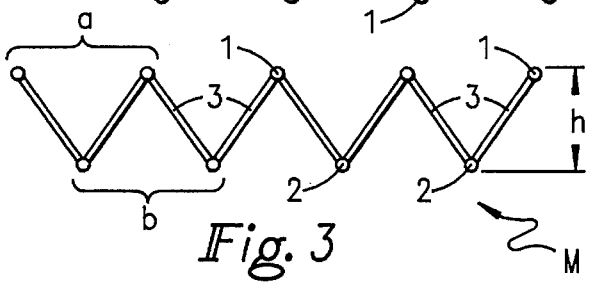
FIG. 3 is a transverse cross-sectional view of the net of FIG. 2.
Figure 9:
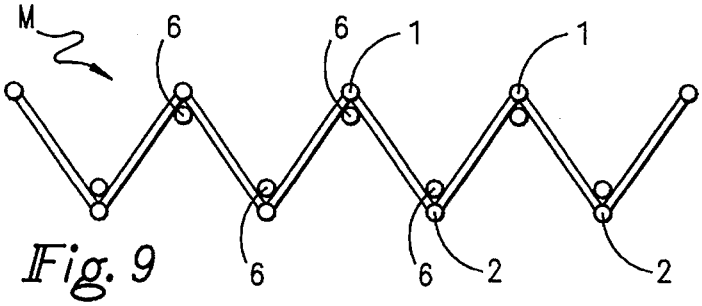
FIG. 9 is a transverse cross-sectional view illustrating a reinforcing net according to a modified form of the invention including additional longitudinally extending iron rods in accordance with specific structural static calculations.
Figure 10:
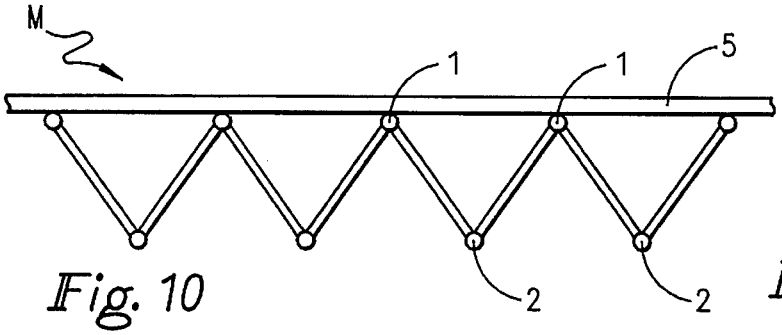
FIG. 10 is a longitudinal cross sectional view illustrating a reinforcing net according to a modified form of the invention including additional transversely extending iron rods in accordance with specific structural static calculations.

FIGS. 9 and 10 illustrate transverse cross-sectional views of a modified form of the invention, similar to the view depicted in FIG. 3, in which a plurality of reinforcing rods 5 and 6 connected respectively to the rods 1 and 2, are optionally provided. These reinforcing rods may be disposed transversely as illustrated in FIG. 10 in association with rods 5, or longitudinally as illustrated in FIG. 9 in association with rods 6.

The addition of the reinforcing rods 5 and 6 may be made in any variation of the invention and may be secured in any conventional manner, for example by welding or tied with wire.

The nets M and M' according to the present invention may be utilized in the construction of reinforced concrete slabs, in which the structural elements conforming the net replace the traditional inclined beams illustrated in FIGS. 13*a* and 13*b* and FIG. 14.

Figure 6:
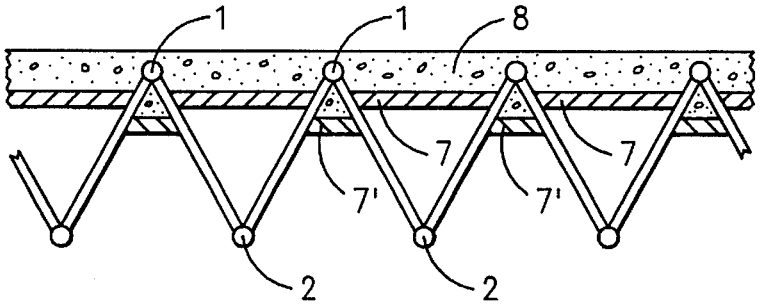
FIG. 6 is a transverse cross-sectional view illustrating a section of the net of FIG. 1 incorporating permanent forms which makes possible to the pouring of a concrete slab with no additional supports.
Figure 7:
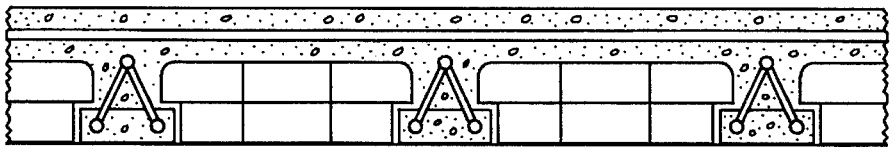
FIG. 7 is a transverse cross sectional view illustrating a reinforced concrete waffle type slab construction incorporating precast reinforced concrete beams.
Figure 7A:
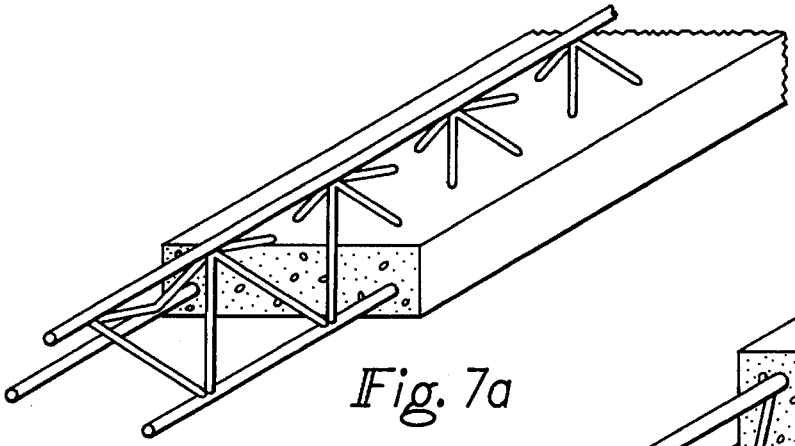
FIG. 7*a* is a perspective detail view illustrating a precast concrete beam of the type employed in the construction of FIG. 7.
Figure 8A:
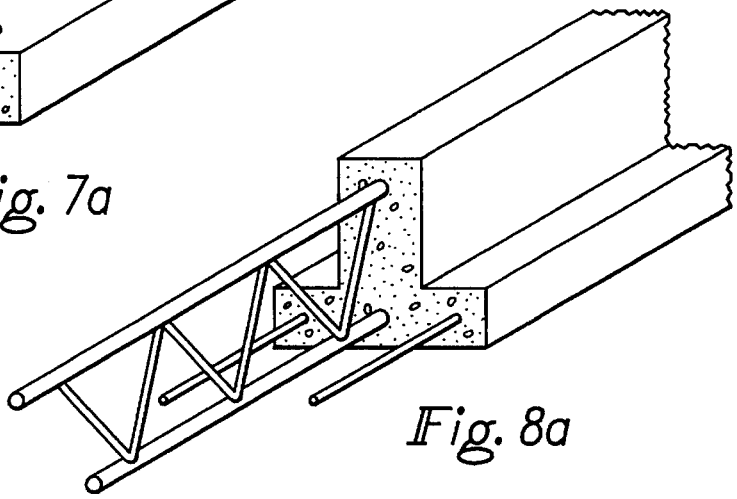
FIG. 8*a* is a perspective detail view illustrating a precast concrete beam of the type employed in the construction of FIG. 8.
Figure 8:
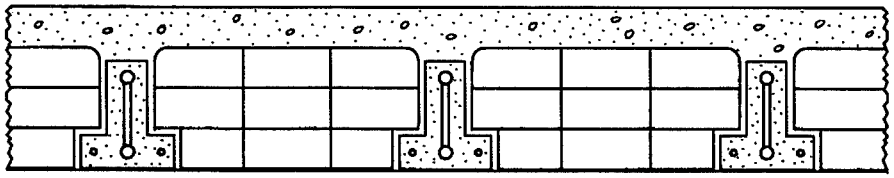
FIG. 8 is a transverse cross sectional view illustrating a modified reinforced concrete waffle type slab construction incorporating a modified precast concrete beam.

FIG. 6 illustrates an example construction technique employing the net M of the invention in connection with the pouring of a concrete slab 8. Permanent forms 7 and 7' made of economical lightweight material such as bricks, expanded foam (e.g. STYROFOAM), drywall, fiberglass, plywood, etc., are employed to retain the concrete 8 when poured and prior to curing. The forms 7 and 7' fill the empty spaces of the net M and also form a constructive element providing a compression zone to accommodate thermal expansion and contraction, and also to provide insulation. Forms 7 comprise planar elongated rectangular members dimensioned for self-supporting insertion into the V-shaped opening formed between each adjacent pair of rods 1 comprising the upper rim a of the net M. Similar, but narrower, elongated rectangular members comprise forms 7', which are inserted into the downwardly opening V-shaped openings between each adjacent pair of rods 2 comprising the lower rim b of the net M. Forms 7' may be held in position by connecting wires, or other conventional fastening techniques. After the cement 8 is poured, the forms 7 and 7' are left permanently in position. After completion of the pour, the lower rods 2 as well as portions of the connecting rods 3 remain exposed, and may be utilized for convenient securement of electrical boxes, suspending ceilings, insulation, lighting fixtures, sprinkling systems, partition wall systems, and a variety of other conventional construction elements.

Figure 11A:
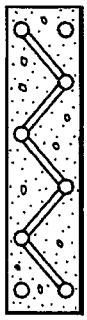
FIG. 11*a* is a diagrammatic cross-sectional view illustrating a first example column construction formed according to the method and apparatus of the present invention.
Figure 11B:
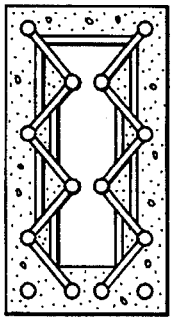
FIG. 11*b* is a diagrammatic cross-sectional view illustrating a second example column construction formed according to the method and apparatus of the present invention.
Figure 11C:
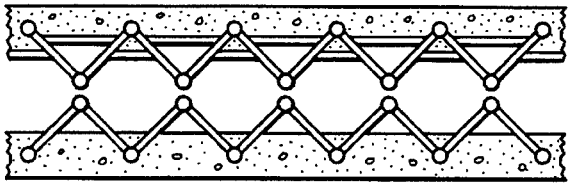
FIG. 11*c* is a diagrammatic cross-sectional view illustrating a third example column construction formed according to the method and apparatus of the present invention.
Figure 11D:
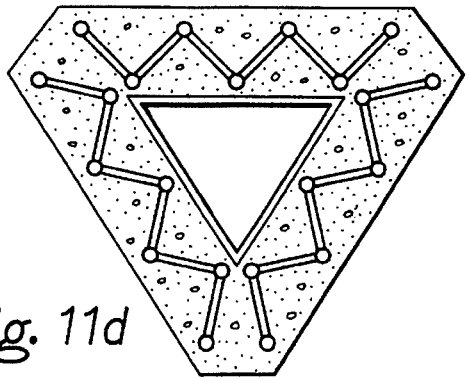
FIG. 11*d* is a diagrammatic cross-sectional view illustrating a fourth example column construction formed according to the method and apparatus of the present invention.
Figure 12A:
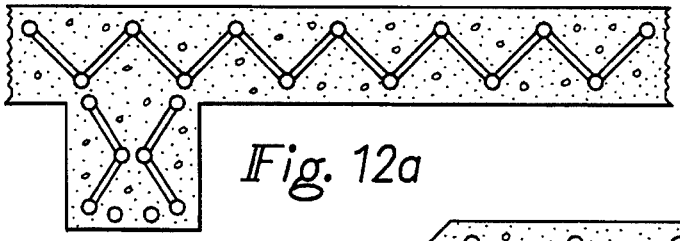
FIG. 12*a* is a diagrammatic transverse cross-sectional view which illustrates an example beam supported slab formed according to the method and apparatus of the present invention.
Figure 12B:
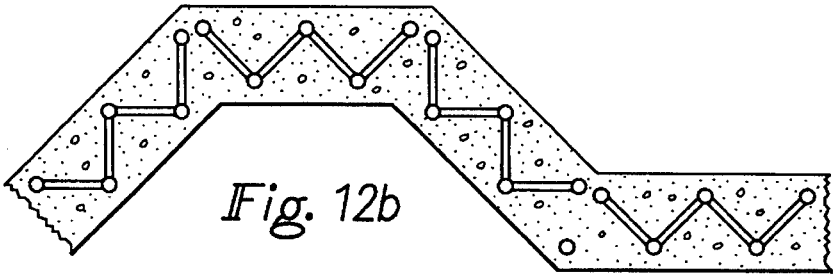
FIG. 12*b* is a diagrammatic transverse cross-sectional view which illustrates an example non-planar slab constructed according to the method and apparatus of the present invention.

FIGS. 11*a-b-c-d* illustrate a variety of different solid and form beams and columns, each one incorporating armours constituted by longitudinal pieces of the net M of the instant invention, with width, height and shape determined according to particular previously calculated design load requirements.

The constructive configuration of the net makes it self-standing, obviating the need for any additional scaffolding or other temporary supporting structure, which in conjunction with the use of permanent forms described above in connection with FIG. 6, allows the pouring of concrete at any stage during the structural assembly of any particular project employing the construction method of the present invention. These characteristics are particularly important for high rise construction in that a considerable reduction in construction time and costs result from the obviation of the need for erecting temporary support structures and concrete forms.

The net of the invention may also used to form retention walls where location conditions (weather, land crumbling, reduced space, etc.) or particular constructions bridges, aqueducts, etc.) demand a faster erection and completion.

Other advantages of the present invention may be achieved in connection with the construction of slabs or other structures disposed at high elevations. In traditional methods of constructing reinforced concrete mezzanines located in high places, it is necessary to provide load support utilizing bricks or expensive light weight framework in order to reduce the weight of the iron. The net of the invention, results in a much lighter weight construction since it replaces a significant portion of the ordinarily required concrete by the compression iron of the upper rim a. If the concrete of that superior coat is taken as a constructive element absorbing the compression efforts, it becomes evident a reduction of iron in upper rim zone.

Advantages achieved by the present invention include:

1) Substitution of traditional slabs, filling the empty spaces with concrete over a form located among the rods of the upper rim of the net, resulting in substantial weight reduction.
2) Versatility: a net is able to increase its capacity to admit a larger load by the simple addition of more reinforcement rods or the use of higher gage rods.
3) Different applications: as retention walls, in high constructions requiring costly scaffolds and forms such as bridges and aqueducts.
4) Self-standing condition: as it needs no props when the concrete is poured, it is possible to construct high buildings completely; that is to say, to make the whole metallic frame first and then pour the concrete.
5) Easy transportation: the possibility of stacking plurality of sections of the net in nested relation achieves an important reduction in volume, thus minimizing storage and transportation costs.
6) It admits the incorporation of additional rods, superposition of nets, concrete covering, etc.
7) The ability to preform net sections at a factory according to exact design specifications obviates expensive field assembly.
8) The elimination of set up, takedown, and cleaning costs associated with conventional concrete forming construction methods.
9) The reduction in material volume and quantity requirements for particular design load requirements.
10) The ability to cut the net to form individual truss members according to particular design requirements.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of reinforced concrete construction, comprising the steps of:

providing a reticulated net including:

a first plurality of evenly spaced parallel coplanar rods forming an upper rim;

a second plurality of evenly spaced parallel coplanar rods forming a lower rim;

said rods in said upper rim laterally offset relative to said rods in said lower rim; and a pair of connecting rods each having a triangular waveform configuration connecting each of said rods in said upper rim, excepting two laterally outermost rods of said upper rim, to an adjacent pair of said rods in said lower rim forming an integral reticulated net having a triangular waveform configuration and possessing alternately upwardly and downwardly opening V-shaped openings, said connecting rods disposed in planes obliquely intersecting planes of said upper and lower rims;

placing a first plurality of elongated individual rectangular permanent forms within said upwardly opening V-shaped openings between rods in said upper rim of said net;

placing a second plurality of elongated individual rectangular permanent forms within said downwardly opening V-shaped openings between rods in said lower rim of said net; and pouring concrete at least partially over said net to form a reinforced concrete structure.

2. The method of claim 1, further comprising the step of leaving at least a portion of said lower rim of said net exposed to facilitate securement of various construction elements thereto.

3. The method of claim 1, wherein adjacent connected pairs of rods in said upper and lower rims form separable truss members.

4. The method of claim 1, wherein said rods have a circular transverse cross-sectional shape.

5. The method of claim 1, wherein said rods are formed of material selected from the group consisting of galvanized iron, stainless steel, aluminum, and plastic.

6. The method of claim 1, further comprising the step of varying the gage of said rods in different locations of the net for accommodating different design loads for diverse locations within the same net.

7. The method of claim 1, further comprising the step of securing said rods together by welding.

8. The method of claim 1, further comprising the step of tying said rods together with wire.

9. The method of claim 1, wherein said forms are formed from a material selected from the group consisting of bricks, expanded foam, drywall, fiberglass, and plywood.

10. The method of claim 2, further comprising the step of securing at least one construction element to said lower rim of said net, said at least one construction element selected from the group consisting of electrical boxes, suspending ceilings, insulation, lighting fixtures, sprinkling systems, and partition wall systems.

11. The method of claim 1, wherein said reinforced concrete structure is selected from the group consisting of slabs, beams, and columns.

* * * * *